US009033295B2

(12) United States Patent
Zobel et al.

(10) Patent No.: US 9,033,295 B2
(45) Date of Patent: May 19, 2015

(54) DISPLAY FIXTURE HAVING A DISPLAY HOOK

(71) Applicant: Target Brands, Inc., Minneapolis, MN (US)

(72) Inventors: Erin L. Zobel, Minneapolis, MN (US); Jason W. Johnson, Wayzata, MN (US)

(73) Assignee: Target Brands, Inc., Minneapolis, MN (US)

( * ) Notice: Subject to any disclaimer, the term of this patent is extended or adjusted under 35 U.S.C. 154(b) by 75 days.

(21) Appl. No.: 13/922,868

(22) Filed: Jun. 20, 2013

(65) Prior Publication Data

US 2014/0374556 A1 Dec. 25, 2014

(51) Int. Cl.

| | |
|---|---|
| ***A47B 96/06*** | (2006.01) |
| ***A47F 5/00*** | (2006.01) |
| ***A47F 5/08*** | (2006.01) |

(52) U.S. Cl.

CPC ..... *A47F 5/0006* (2013.01); *Y10T 29/49959* (2015.01); *A47F 5/0823* (2013.01)

(58) Field of Classification Search

CPC ..... A47F 5/0006; A47F 5/0823; Y10T 29/49959

USPC ..... 248/220.4, 220.3, 221.1, 224.8, 220.1; 211/57.1, 54.1, 59.1

See application file for complete search history.

(56) References Cited

U.S. PATENT DOCUMENTS

| | | | | |
|---|---|---|---|---|
| 2,194,191 | A * | 3/1940 | Wolf | 211/96 |
| 2,842,264 | A | 7/1958 | Larson | |
| 2,901,116 | A | 8/1959 | Daley | |
| 2,987,195 | A | 6/1961 | Smith | |
| 3,289,994 | A | 12/1966 | Burmeister | |
| 3,715,096 | A | 2/1973 | Filbert | |
| 4,209,156 | A | 6/1980 | Kashden | |
| 4,516,681 | A | 5/1985 | Jahel | |
| 4,606,466 | A * | 8/1986 | Fredrickson | 211/59.1 |
| 4,720,016 | A | 1/1988 | Kay | |
| 5,038,946 | A | 8/1991 | Tenser et al. | |
| 5,303,830 | A | 4/1994 | Metcalf | |
| 5,441,161 | A | 8/1995 | Merl | |
| 6,349,909 | B1 | 2/2002 | Zarrow et al. | |
| 6,481,677 | B1 | 11/2002 | Yu | |
| 6,530,486 | B1 | 3/2003 | Batting et al. | |
| 6,588,607 | B2 | 7/2003 | Smith et al. | |
| 6,612,057 | B2 | 9/2003 | Shoemaker et al. | |
| 6,860,456 | B2 | 3/2005 | Magnusson | |
| 7,546,926 | B2 | 6/2009 | Stolle et al. | |
| 7,882,964 | B2 * | 2/2011 | Battaglia | 211/59.1 |
| 2006/0196839 | A1 | 9/2006 | Stolle et al. | |
| 2009/0308821 | A1 | 12/2009 | Brand et al. | |
| 2012/0160788 | A1 | 6/2012 | Kopsak | |

OTHER PUBLICATIONS

Southern Imperial, Inc., Display & Fixture Solutions Guide, catalog p. 27, at least as early as May 2013.

* cited by examiner

*Primary Examiner* — Amy Sterling

(74) *Attorney, Agent, or Firm* — Leanne Taveggia Farrell; Westman, Champlin & Koehler, P.A.

(57) ABSTRACT

A display fixture includes a cross support mounted to a display structure. The cross support includes a cross bar having a plurality of holes extending through at least a top of the cross bar. The holes are spaced apart from each other across a length of the cross bar. The display fixture also includes at least one display hook having three downwardly depending mounting members. The at least display hook is mounted to the cross bar by engaging two of the three downward depending mounting members with two holes in the cross bar.

18 Claims, 9 Drawing Sheets

DISPLAY FIXTURE HAVING A DISPLAY HOOK

BACKGROUND

Businesses, such as retail stores, use a variety of types of display structures to present products and related information to customers for purchase. A display hook is one type of component that is used with a display structure to support hanging products that are being offered for sale. Exemplary display hooks include hooks for mounting to cross bars or cross wire supports, hooks for mounting to peg boards and hooks for mounting to slatted walls.

The discussion above is merely provided for general background information and is not intended to be used as an aid in determining the scope of the claimed subject matter.

SUMMARY

A display fixture includes a cross support mounted to a display structure. The cross support includes a cross bar having a plurality of holes extending through at least a top of the cross bar. The holes are spaced apart from each other across a length of the cross bar. The display fixture also includes at least one display hook having three downwardly depending mounting members. The at least display hook is mounted to the cross bar by engaging two of the three downward depending mounting members with two holes in the cross bar.

The display hook includes a loop member having a pair of parallel stems integrally connected at a free end of the loop member and a pair of parallel prongs. Each of the pair of parallel stems are integrally coupled to one of the pair of parallel stems, are oriented downwardly from the stems and terminate at mounting ends of the loop member. The display hook also includes an arm coupled to and located between the pair of parallel stems of the loop member and having a single stem and a prong. The prong is integrally coupled to the single stem, is oriented downwardly from the single stem and terminates at a mounting end of the arm.

A method of mounting a display fixture to a display structure includes mounting a cross bar to the display structure and mounting a display hook to the cross bar by inserting two of the three downwardly depending mounting members into two holes in the cross bar.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display hooks in the embodiments described below are mounted to a cross support, which is attached to a display structure for display in a business, such as a retail store. The display hooks are provided to display hanging products or merchandise and to display label holders for holding a price label or other type of label containing indicia related to the hanging products that are on display. The display hooks are multi-configurable in that they can be oriented at different angles relative to the cross support to which they are mounted.

Figure 1:
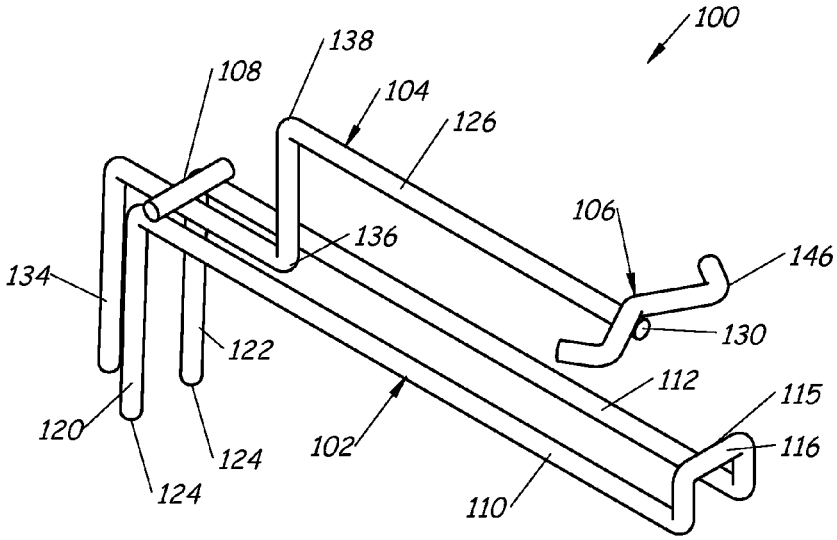
FIG. 1 is a perspective view of a display hook according to one embodiment.
Figure 2:
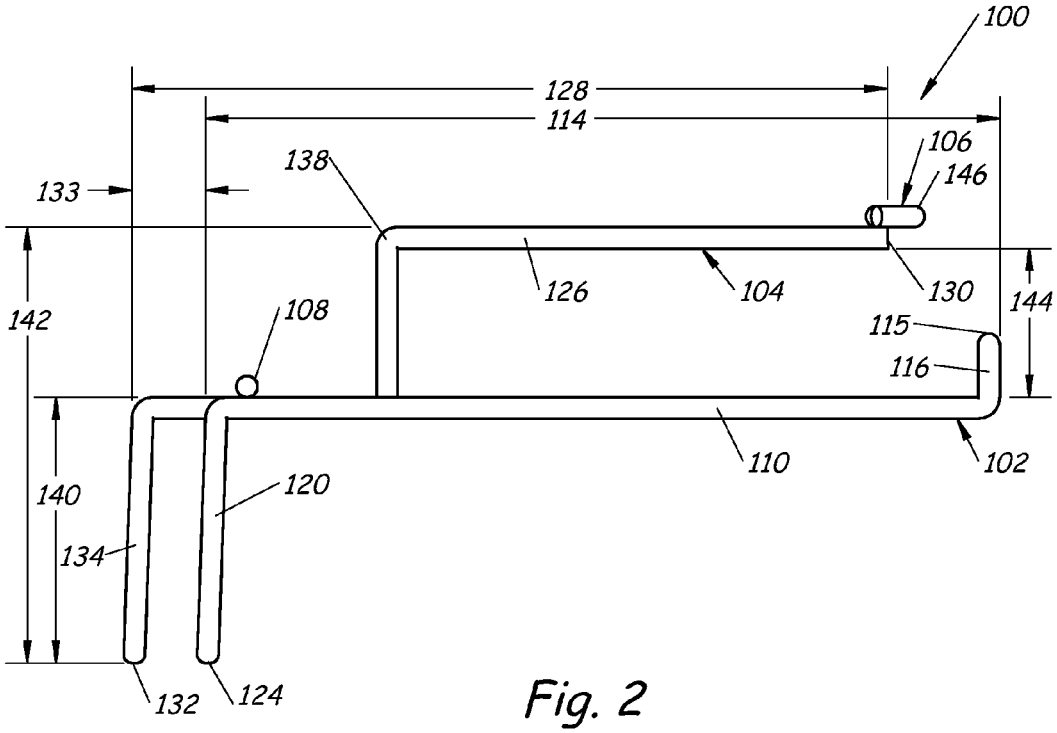
FIG. 2 is a side view of the display hook illustrated in FIG. 1.
Figure 3:
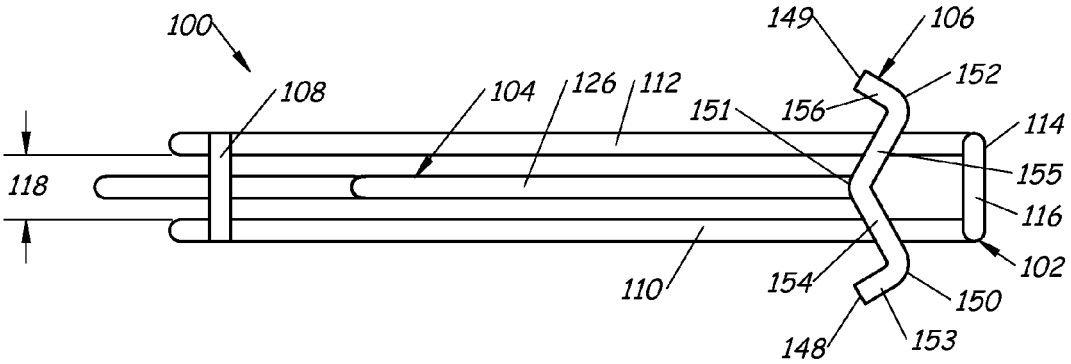
FIG. 3 is a top view of the display hook illustrated in FIG. 1.
Figure 4:
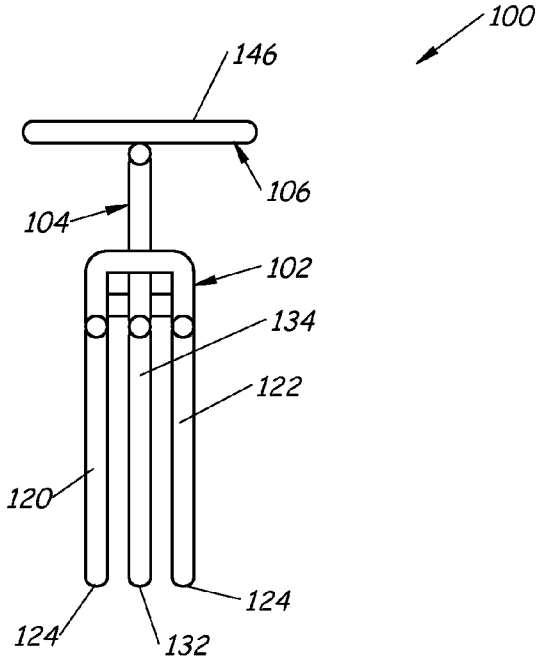
FIG. 4 is a front view of the display hook illustrated in FIG. 1.

FIG. 1 is a perspective view of a display hook or hanger 100 according to one embodiment. FIGS. 2-4 are a side view, a top view and a front view, respectively, for the display hook or hanger 100 illustrated in FIG. 1. Display hook 100 includes a loop member 102, an arm 104 and a label holder support 106. Loop member 102 is indirectly coupled to arm 104 by a cross piece 108 and label holder support 106 is directly coupled to arm 104. In one embodiment, loop member 102, arm 104 and label holder support 106 are all made of a metal wire stock. However, it should be realized that other types of materials can be used including various types of extruded polymers.

Loop member 102 having a free end or distal end 115 and mounting ends or proximal end 124 includes a pair of parallel stems or rods 110 and 112. The pair of parallel stems 110 and 112 substantially define a length 114 of loop member 102 and are integrally connected at a free end or distal end 115 of loop member 102 by a connecting end piece 116. Parallel stems 110 and 112 are spaced apart from each other by a distance 118 and are configured to receive hanging product for display. Distance 118 between parallel stems 110 and 112 can vary depending on a variety of different factors including, for example, the type of structure to which display hook 100 is attached and the weight and dimensions of the product that loop member 102 is to display. Loop member 102 also includes a pair of prongs 120 and 122. Each prong 120 and 122 is integrally coupled to and oriented downwardly from one of the stems 110 and 112, respectively. Each prong 120 and 122 terminates at one of the proximal ends 124 of loop member 102 and are oriented in parallel with each other.

Arm 104 having a free end or distal end 130 and a mounting end or proximal end 132 includes a single stem or rod 126 that is located between the pair of parallel stems 110 and 112 of loop member 102 and is configured to support a label holder. Single stem 126 substantially defines a length 128 of arm 104. Arm 104 also includes a prong 134 that is integrally coupled to and oriented downwardly from stem 126. Prong 134 terminates at mounting end 132 of arm 104. Prong 134 of arm 104 and prongs 120 and 122 of loop member 102 are all oriented in parallel with each other. As illustrated in FIG. 2, the mounting ends 124 of loop member 102 are located distally from mounting end 132 of arm 104 or in closer proximity to free end or distal end 130 of arm 104 than mounting end 132 of arm 104. More specifically, mounting ends 124 of loop member 102 are located a distal distance 133 from mounting end 132 of arm 104. Yet another way to describe the relative positions of prongs 120, 122 and 134 includes describing two of the downwardly depending prongs as being located in the same, single plane and the third downwardly depending prong being located outside of that single plane. For example, prongs 120 and 122 extend along the same, vertical plane, but prong 134 extends outside of that vertical plane. In another example, prongs 120 and 134 extend along the same, vertical plane, but prong 122 extends outside of that vertical plane. In yet another example, prongs 122 and 134 extend along the same, vertical plane, but prong 120 extends outside of that vertical plane.

Stem 126 of arm 104 includes a first bend 136 and a second bend 138. As illustrated in FIGS. 1 and 2, a portion of stem 126 that extends between prong 134 and first bend 136 is not only in parallel with the pair of parallel stems 110 and 112, but also extends along a height 140 relative to mounting end 132 that is substantially the same as the height of the pair of parallel stems 110 and 112 relative to mounting ends 124. Although a portion of stem 126 that extends between second bend 138 and free end 130 is also in parallel with the pair of parallel stems 110 and 112, first bend 136 and second bend 138 allows this portion to be located at a height 142 relative to mounting end 132 that is greater than height 140 of the pair of parallel stems 110 and 112. In other words, the portion of stem 126 that extends between second bend 138 and free end 130 is spaced above the pair of parallel stems 110 and 112 by a distance 144.

Label holder support 106 is directly coupled to free end 130 of arm 104 by, for example, spot welding, and is configured to support a label holder. For example, label holder support 106 can support a label holder that is configured to receive a price label or other type of label containing indicia related to the product that is being displayed on display hook 100. Label holder support 106 comprises a support member 146 having a first free end 148 and a second free end 149. Label holder support 106 further includes three bends 150, 151 and 152 that define four legs 153, 154, 155 and 156. First leg 153 is defined between free end 148 and first bend 150, second leg 154 is defined between first bend 150 and second bend 151, third leg 155 is defined between second bend 151 and third bend 152 and fourth leg 156 is defined between third bend 152 and free end 149.

Figure 5:
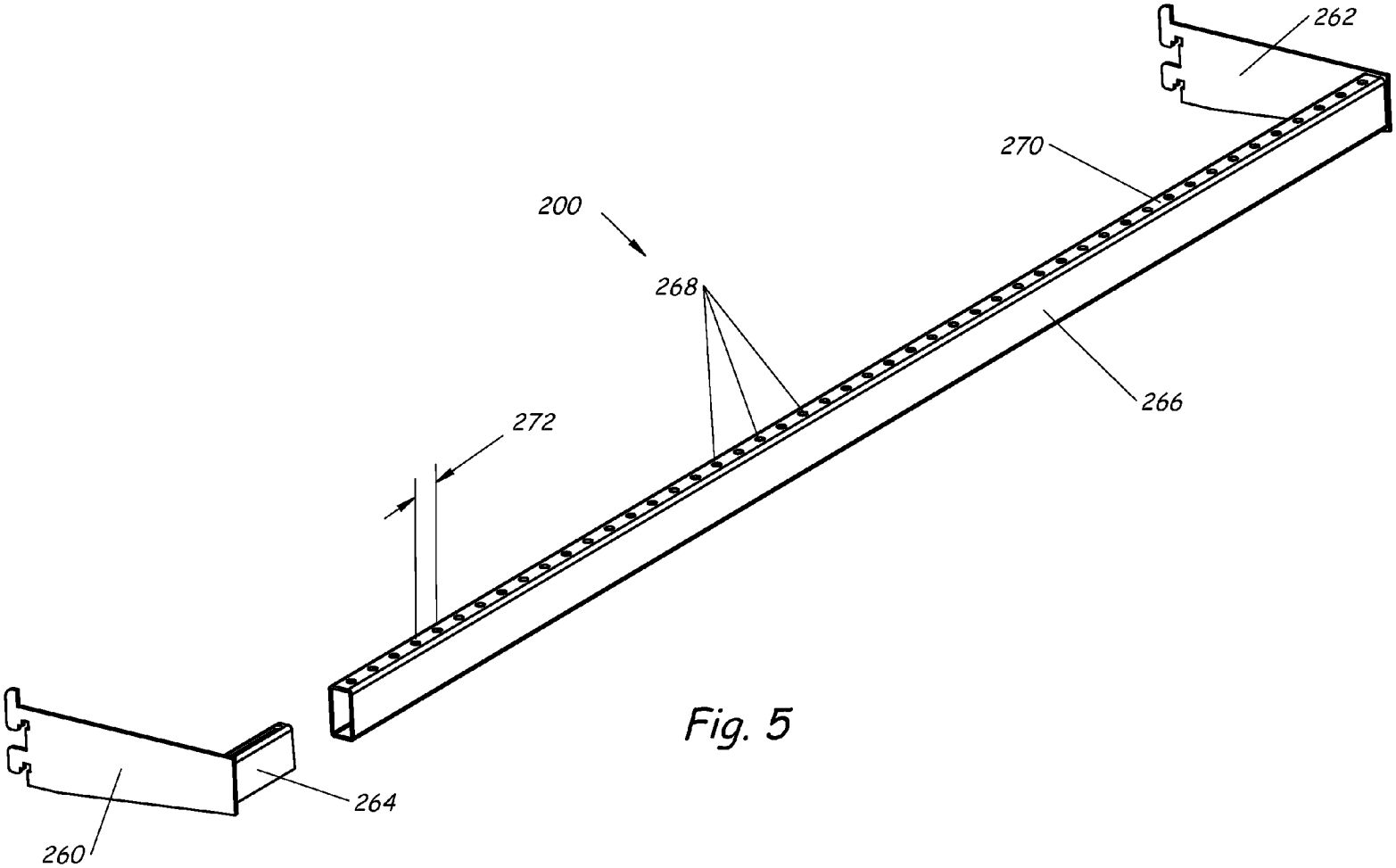
FIG. 5 is an exploded perspective view of a cross support according one embodiment.
Figure 6:
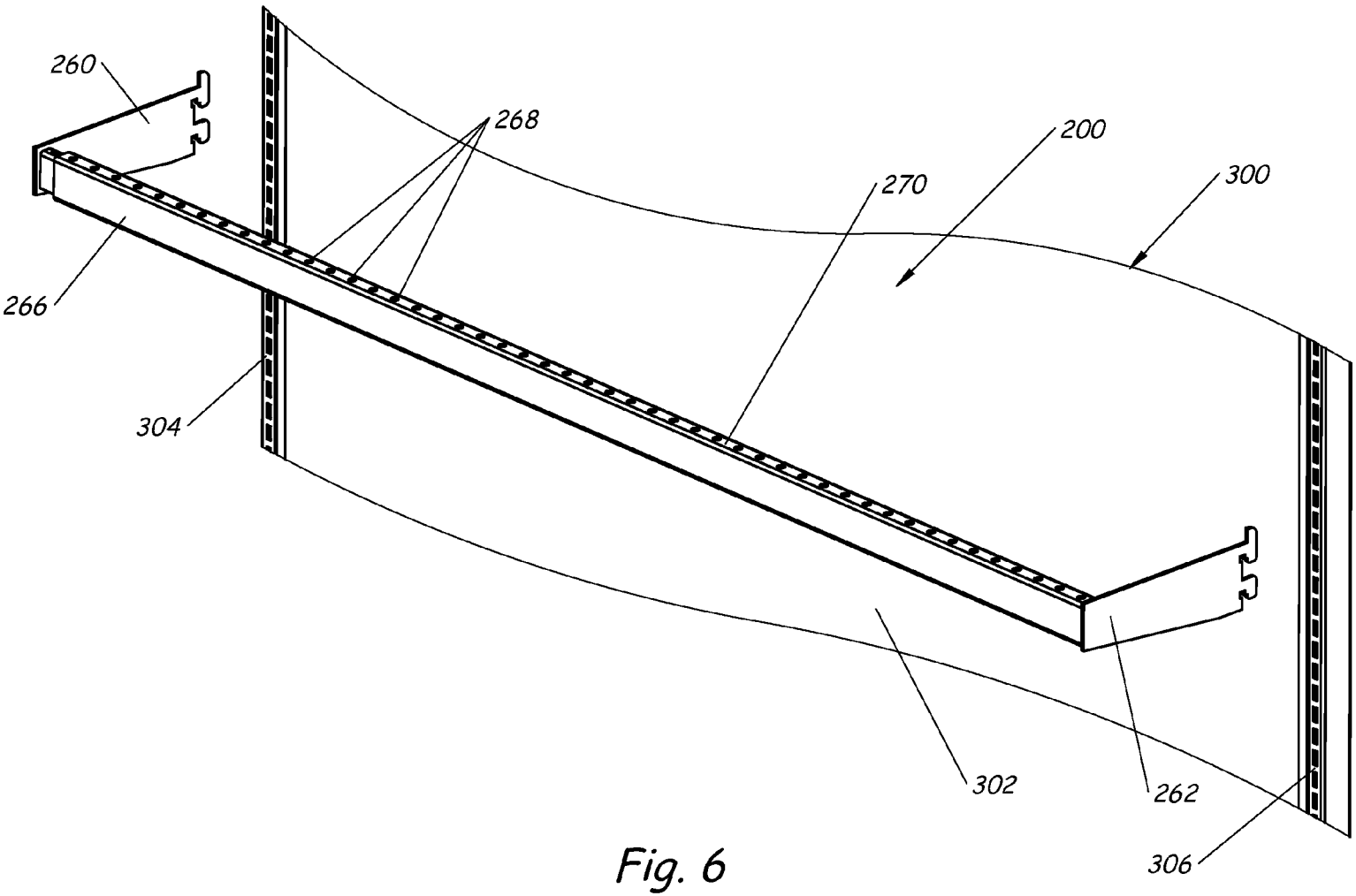
FIG. 6 illustrates the cross bar in FIG. 5 as assembled and being mounted to a wall of a display structure.

FIG. 5 is an exploded perspective view of a cross support 200 according to one embodiment and FIG. 6 illustrates assembled cross support 200 being mounted to a wall of a display structure. In one embodiment and as illustrated in FIG. 6, the display structure is a gondola 300. A gondola is a freestanding display fixture used to display products and merchandise. Gondola 300 includes a flat, substantially horizontal base or base deck (not illustrated) and a substantially vertical back wall 302 supported by a pair of slotted uprights 304 and 306. The substantially vertical back wall 302 can feature notches, a pegboard and/or a slat wall. In FIG. 6, the substantially vertical back wall 302 is a pegboard. Gondolas placed side-by-side form rows that define aisles in a retail store. In the embodiments described herein, cross support 200 can be mounted to the slotted uprights 304 and 306 of the substantially vertical back wall 302 of gondola 300.

Cross support 200 includes a pair of brackets 260 and 262 for mounting cross support 200 to a display structure, such as slotted uprights 304 and 306 of gondola 300. Cross support 200 also includes a telescopic arm 264 and a cross bar 266. Telescopic arm 264 is attached to bracket 260 and is configured to receive or slidably engage with cross bar 266, which is coupled to bracket 262. Telescopic arm 264 allows the distance between bracket 260 and bracket 262 or the length of cross support 200 to be adjusted depending upon the distance brackets 260 and 262 need to be apart from each other to be mounted to a display structure. For example, cross bar 266 is slidable over telescopic arm 264 to adjust the distance between bracket 260 and 262 for fitting on different width gondolas.

Cross bar 266 includes a plurality of holes 268 extending at least through a top 270 of cross bar 266. In one embodiment, each hole 268 can be evenly spaced apart from each other by a distance 272. For example, distance 272 is substantially similar to distance 118 (FIG. 3) that separates prong 120 from prong 122, substantially similar to distance 119 (FIG. 8) that separates prong 134 from prong 120 and substantially similar to distance 121 (FIG. 10) that separates prong 134 from prong 122.

Figure 7:
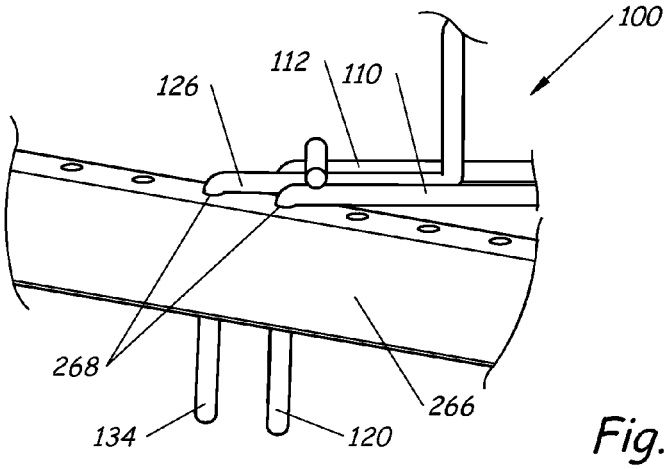
FIG. 7 illustrates a perspective view of the display hook illustrated in FIG. 1 mounted to the cross bar illustrated in FIG. 5 in a first configuration.
Figure 8:
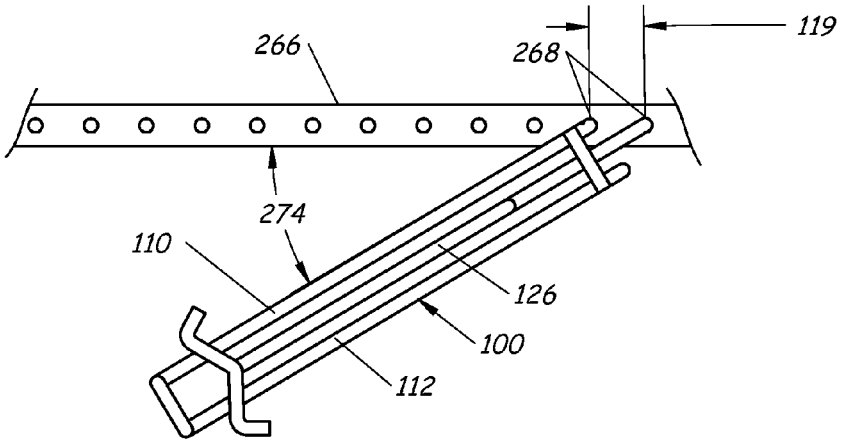
FIG. 8 illustrates a top view of the display hook illustrated in FIG. 1 mounted to the cross bar illustrated in FIG. 5 in the first configuration.
Figure 9:
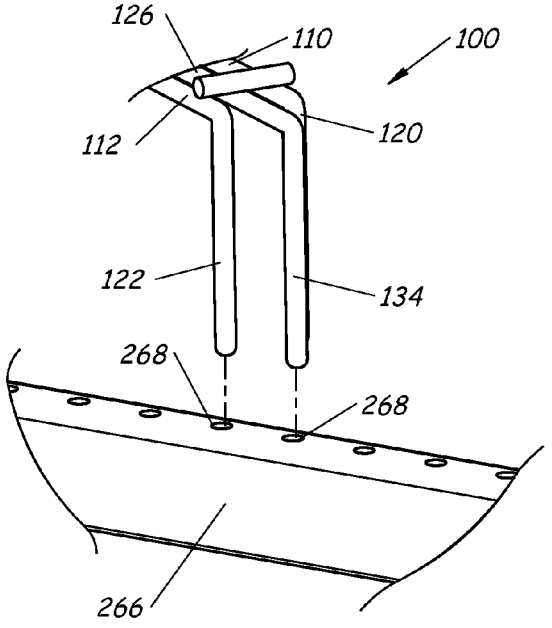
FIG. 9 illustrates a perspective view of the display hook illustrated in FIG. 1 being mounted to the cross bar illustrated in FIG. 5 in a second configuration.
Figure 10:
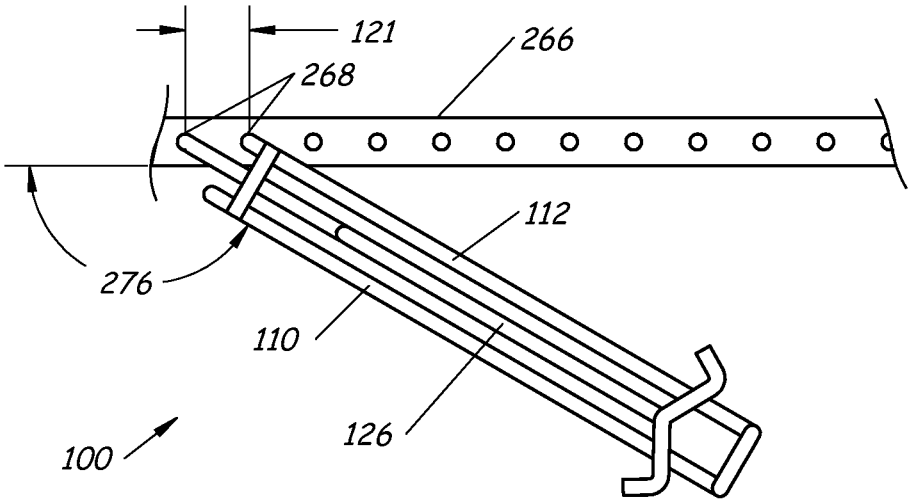
FIG. 10 illustrates a top view of the display hook illustrated in FIG. 1 mounted to the cross bar illustrated in FIG. 5 in the second configuration.
Figure 11:
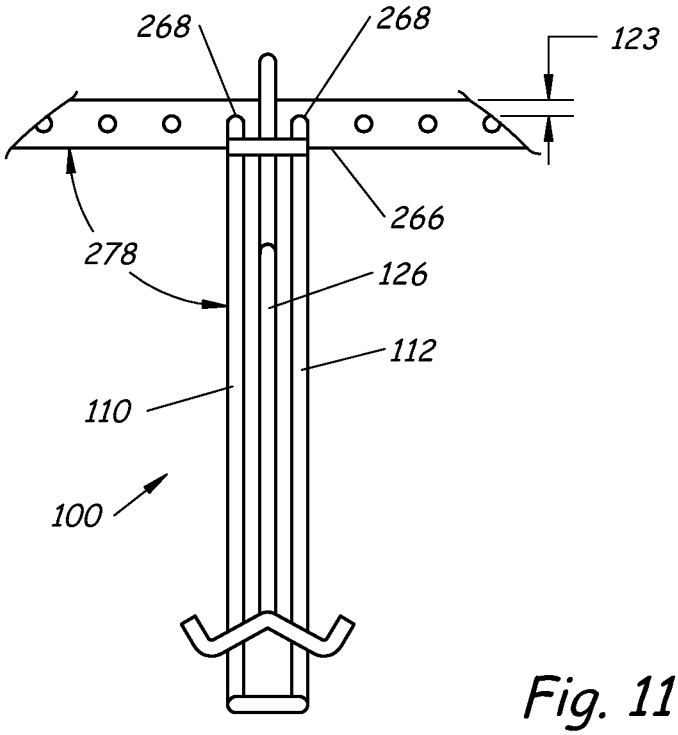
FIG. 11 illustrates a top view of the display hook illustrated in FIG. 1 mounted to the cross bar illustrated in FIG. 5 in a third configuration.

FIG. 7 illustrates a perspective view and FIG. 8 illustrates a top view of display hook 100 mounted to cross bar 266 in a first configuration. FIG. 9 illustrates a perspective view of display hook 100 being mounted to cross bar 266 in a second configuration, and FIG. 10 illustrates a top view of display hook 100 mounted to cross bar 266 in a second configuration. FIG. 11 illustrates a top view of display hook 100 mounted to cross bar 266 in a third configuration. As illustrated in FIGS. 7-11, display hook 100 is mounted to cross bar 266 by engaging or inserting two of the three prongs or two of the three downwardly depending mounting members of display hook 100 with or into two holes 268 in cross bar 266. In one embodiment and as illustrated in FIG. 7-11, two of the three downwardly depending mounting members of display hook 100 are engaged or inserted into two holes 268 in cross bar 266. For example, the two holes 268 can be adjacent holes 268.

In the embodiment illustrated in FIGS. 7 and 8, one of the prongs of loop member 102, such as prong 120 that is integrally connected to stem 110, is inserted into a hole 268 in cross bar 266. In addition, in FIGS. 7 and 8, prong 134 that is integrally connected to stem 126 of arm 104 is inserted into an adjacent hole 268 in cross bar 266. In this first configuration, the insertion of two prongs (e.g., prong 120 and prong 134) prevents display hook 100 from swaying and orients display hook 100 at a first angle 274 relative to cross bar 266. In FIGS. 7 and 8, first angle 274 is less than 90 degrees, but greater than 0 degrees. For example, first angle 274 can be about 33 degrees.

In the embodiment illustrated in FIGS. 9 and 10, the other of the prong of loop member 102, such as prong 122 that is integrally connected to stem 112, is inserted into a hole 268 in cross bar 266. In addition, in FIGS. 9 and 10, prong 134 that is integrally connected to stem 126 of arm 104 is inserted into an adjacent hole 268 in cross bar 266. In this second configuration, the insertion of two prongs (e.g. prong 122 and prong 134) prevents display hook 100 from swaying and orients display hook 100 at a second angle 276 relative to cross bar 266. In FIG. 10, second angle 276 is greater than first angle 274. For example, second angle 276 is greater than 90 degrees, but less than 180 degrees and in one exemplary embodiment, second angle 276 is about 147 degrees.

In the embodiment illustrated in FIG. 11, one prong of loop member 102, such as prong 120 that is integrally connected to stem 110, is inserted into a hole 268 in cross bar 266. In addition, in FIG. 11, the other prong of loop member 102, such as prong 122 that is integrally connected to stem 112, is inserted into an adjacent hole 268 in cross bar 266. In this third configuration, the insertion of two prongs (e.g., prong 120 and prong 122) prevents display hook 100 from swaying and orients display hook 100 at a third angle 278 relative to cross bar 266. In FIG. 11, third angle 278 is greater than first angle 274, but less than second angle 276. In one exemplary embodiment, third angle is about 90 degrees. Also illustrated in FIG. 11 is a distance 123. Distance 123 is a distance from holes 268 to a back of cross bar 266. Distance 123 is less than distal distance 133 (FIG. 2) such that cross bar 266 does not interfere with prong 134 in the third configuration illustrated in FIG. 11.

Figure 12:
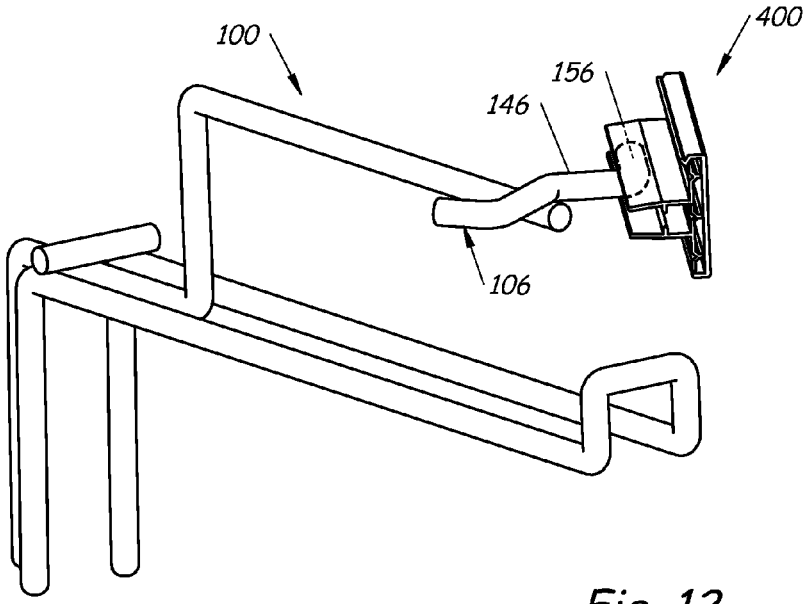
FIG. 12 illustrates a perspective view of the display hook illustrated in FIG. 1 with a label holder mounted in the first configuration thereon.
Figure 13:
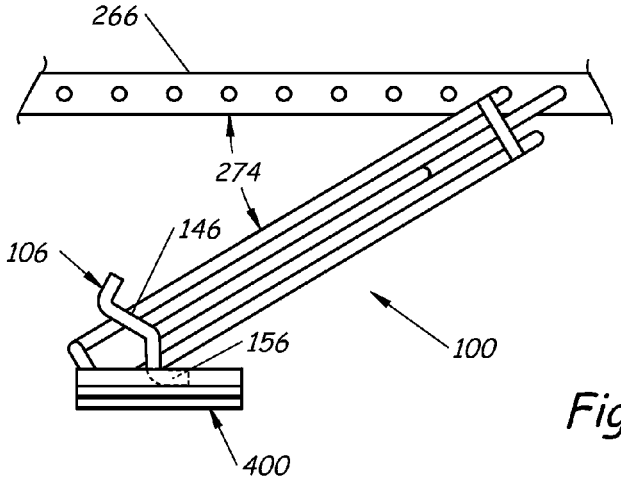
FIG. 13 illustrates a top view of the display hook illustrated in FIG. 1 mounted to the cross bar illustrated in FIG. 5 with a label holder mounted in the first configuration thereon.
Figure 14:
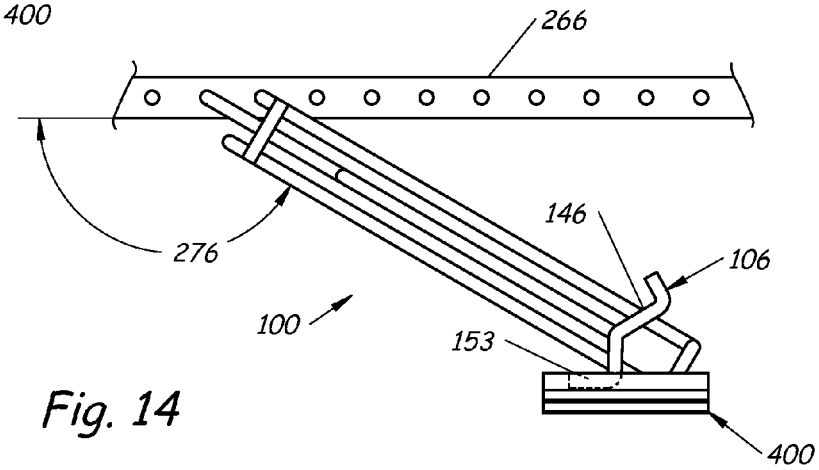
FIG. 14 illustrates a top view of the display hook illustrated in FIG. 1 mounted to the cross bar illustrated in FIG. 5 with a label holder mounted in the second configuration thereon.
Figure 15:
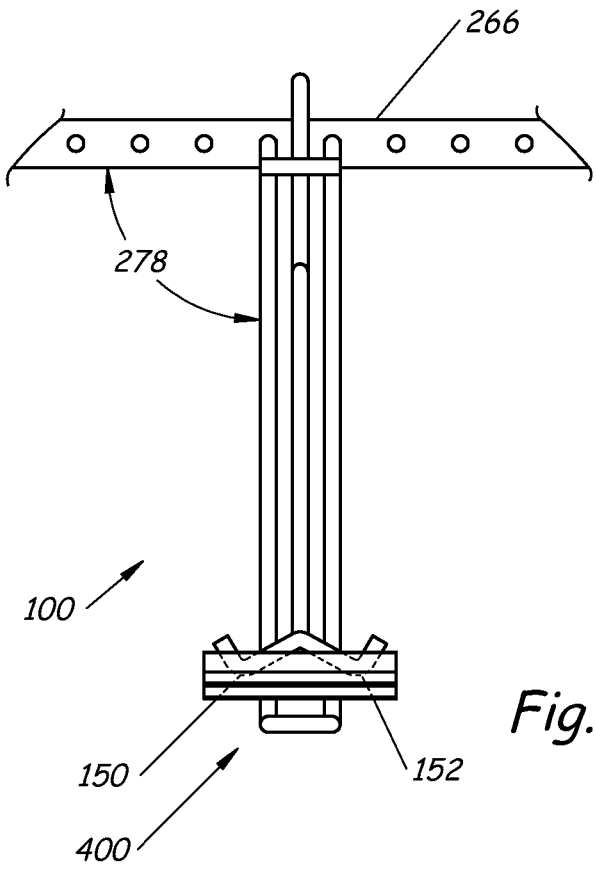
FIG. 15 illustrates a top view of the display hook illustrated in FIG. 1 mounted to the cross bar illustrated in FIG. 5 with a label holder mounted in the third configuration thereon.

FIG. 12 illustrates a perspective view and FIG. 13 illustrates a top view of display hook 100 with a label holder 400 mounted on label holder support 106 in the first configuration. FIG. 14 illustrates a top view of display hook 100 with label holder 400 mounted on label holder support 106 in the second configuration. FIG. 15 illustrates a top view of display hook 100 with label holder 400 mounted on label holder support 106 in the third configuration.

The configuration or angle at which display hook 100 is oriented relative to cross bar 266 determines how label holder 400 is supported on label holder support 106. In the embodiment illustrated in FIGS. 12 and 13, label holder 400 is mounted onto support member 146 so that label holder 400 faces customers who are viewing display hook 100 in the first configuration by placing label holder 400 in parallel with cross bar 266 or while display hook 100 is oriented at first angle 274. More specifically, support member 146 supports label holder 400 on fourth leg 156, which is illustrated in phantom in FIGS. 12 and 13. As described above, fourth leg 156 is defined between free end 149 (FIG. 3) and third bend 152 (FIG. 3) of support member 146.

In the embodiment illustrated in FIG. 14, label holder 400 is mounted onto support member 146 so that label holder 400 faces customers who are viewing display hook 100 in the second configuration by placing label holder 400 in parallel with cross bar 266 or while display hook 100 is oriented at second angle 276. More specifically, support member 146 supports label holder 400 on first leg 153, which is illustrated in phantom in FIG. 14. As described above, first leg 153 is defined between free end 148 (FIG. 3) and first bend 150 (FIG. 3).

In the embodiment illustrated in FIG. 15, label holder 400 is mounted onto support member 146 so that label holder 400 faces customers who are viewing display hook 100 in the third configuration by placing label holder 400 in parallel with cross bar 266 or while display hook 100 is oriented at third angle 278. More specifically, support member 146 supports label holder 400 on first bend 150 and third bend 152, which is illustrated in phantom in FIG. 15.

Figure 16:
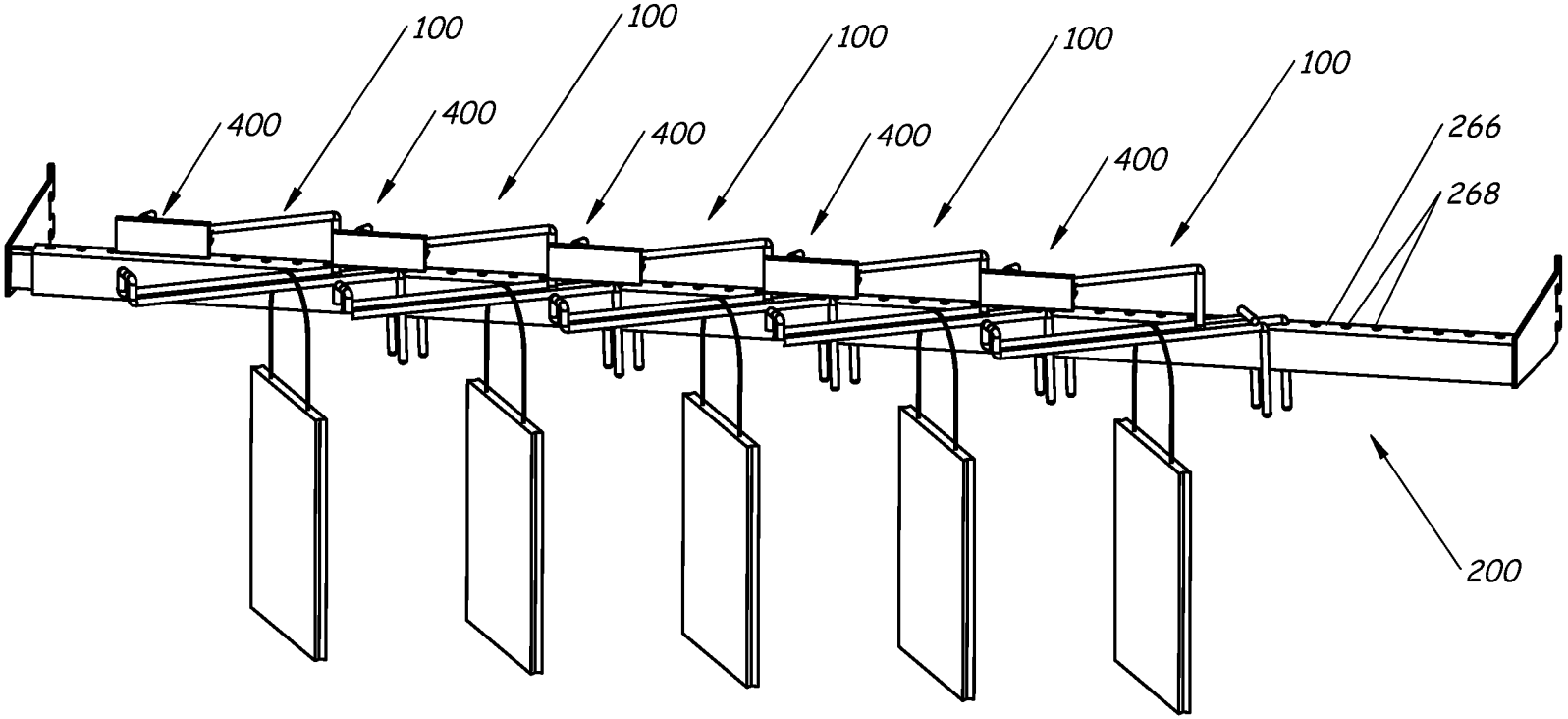
FIG. 16 illustrates a plurality of display hooks each having a label holder mounted thereon and mounted to the cross bar of FIG. 5 in the first configuration.

FIG. 16 illustrates a plurality of display hooks 100 each having a label holder 400 mounted thereon and being mounted to cross bar 266 in the first configuration or while display hooks 100 are all oriented at first angle 274. As illustrated in FIG. 16, two of three downward depending mounting members 120, 122 and 134 are inserted into two adjacent holes in cross bar 266. When mounting a plurality display hooks 100 on the same cross bar 266, all display hooks 100 should be mounted in the same configuration or oriented at the same angle so that each display hook 100 does not interfere with another of the display hooks 100 or so that merchandise, such as the illustrated gift bags, hanging from each display hook 100 do not interfere with merchandise hanging from another of the display hooks 100. In addition, each display hook 100 on cross bar 266 is spaced apart from the display hook 100 to which it is adjacent. As illustrated in FIG. 16, five holes 268 separate each display hook 100 from each other. However, the distance by which display hooks 100 are spaced apart from each other or the number of holes 268 that separate each display hook 100 depend on the size of the merchandise hanging on display hooks 100.

Although not illustrated in FIG. 16, a display structure can receive one or more cross supports 200 above and/or below the cross support 200 illustrated in FIG. 16. The cross supports 200 located above and/or below the cross support 200 illustrated in FIG. 16 can include a plurality of display hooks 100 that are mounted in the same configuration or oriented at the same angle relative to cross bar 266 or can be mounted in a different configuration or oriented at a different angle relative to cross bar 266. For example, a cross support 200 located above the cross support 200 illustrated in FIG. 16 can include a plurality of display hooks 100 oriented relative to the cross bar 266 at the second angle 276, which is different from first angle 274 as illustrated in FIG. 16. To accomplish this, each display hook 100 is mounted to cross bar 266 using two different downwardly depending mounting members than the downwardly depending mounting members used in FIG. 16. In another example, a cross support 200 located below the cross support 200 illustrated in FIG. 16 can include a plurality of display hooks 100 oriented relative to the cross bar 266 at third angle 278, which is different from first angle 274 illustrated in FIG. 16 and second angle 276. To accomplish this, each display hook 100 is mounted to cross bar 266 using two different downwardly depending mounting members than the downwardly depending mounting members used in FIG. 16 or the downwardly depending mounting members used on the cross support 200 located above the cross support 200 illustrated in FIG. 16.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a cross support mounted to a display structure and including a cross bar having a plurality of holes extending through at least a top of the cross bar, the holes being spaced apart from each other across a length of the cross bar; and at least one hanger having first, second and third downwardly depending mounting members, the at least one hanger mounted to the cross bar by engaging two of the first, second and third downwardly depending mounting members with two holes in the cross bar.

2. The display fixture of claim 1, wherein when first and second downwardly depending mounting members are engaged with the two holes, the at least one hanger is oriented at an angle relative to the cross bar that is less than 90 degrees, but greater than 0 degrees.

3. The display fixture of claim 1, wherein when the second downwardly depending mounting member and the third downwardly depending mounting member are engaged with the two holes, the at least one hanger is oriented at an angle relative to the cross bar that is less than 180 degrees, but greater than 90 degrees.

4. The display fixture of claim 1, wherein when the first and the third downwardly depending mounting members are engaged with the two holes, the at least one hanger is oriented at an angle relative to the cross bar that is about 90 degrees.

5. The display fixture of claim 1, wherein the cross support further comprises a pair of brackets for mounting to the display structure and a telescopic arm that engages with the cross bar to adjust a length at which the cross support spans across the display structure.

6. The display fixture of claim 1, wherein the at least one hanger comprises a plurality of hangers each having first, second and third downwardly depending mounting members and being mounted to the cross bar by engaging two of the first, second and third downwardly depending mounting members with two holes in the cross bar, wherein each hanger is spaced apart a distance from each other and wherein the plurality of hangers are oriented at substantially the same angle relative to the cross bar.

7. The display fixture of claim 1, wherein the hanger comprises three rods, each rod being integrally coupled to each downwardly depending mounting member, wherein two of the rods support product for display and wherein the other of the three rods supports a label holder for display.

8. The display fixture of claim 1, wherein the first, second and third downwardly depending mounting members are substantially parallel to each other.

9. The display fixture of claim 8, wherein two of the first, second and third downwardly depending mounting members are located along a single, vertical plane and the other of the first, second and third downwardly depending mounting members is located outside of the single, vertical plane.

10. A display fixture comprising:

a cross bar including a plurality of holes extending through at least a top of the cross bar and being evenly spaced apart from each other across a length of the cross bar; and a display hook having first, second and third prongs that are substantially parallel to each other, wherein two of the prongs are inserted into two of the plurality of holes; and wherein each of the first, second and third prongs are integrally coupled to respective first, second and third stems and each of the first, second and third prongs are oriented downwardly from their corresponding stem and terminate at respective mounting ends.

11. The display fixture of claim 10, wherein the first and second stems are integrally connected together at their free ends to form a loop member that is distally located a distal distance from the mounting ends.

12. The display fixture of claim 10, wherein the third stem is located between the first and second stems.

13. The display fixture of claim 10, further comprising a label holder support coupled to the third stem.

14. The display fixture of claim 10, wherein the third stem comprises a first bend and a second bend, wherein the first bend and the second bend define a portion of the third stem that is spaced a distance above the first and second stems.

15. A display fixture comprising:

a cross support mounted to a display structure and including a cross bar having a plurality of holes extending through at least a top of the cross bar, the holes being spaced apart from each other across a length of the cross bar; and at least one hanger having first, second and third downwardly depending mounting members that are substantially parallel to each other, the at least one hanger mounted to the cross bar by engaging two of the first, second and third downwardly depending mounting members with two adjacent holes in the cross bar;

wherein two of the first, second and third downwardly depending mounting members are located along a single, vertical plane and the other of the first, second and third downwardly depending mounting members is located outside of the single, vertical plane.

16. The display fixture of claim 15, wherein when first and second downwardly depending mounting members are engaged with the two adjacent holes, the at least one hanger is oriented at an angle relative to the cross bar that is less than 90 degrees, but greater than 0 degrees.

17. The display fixture of claim 15, wherein when the second downwardly depending mounting member and the third downwardly depending mounting member are engaged with the two adjacent holes, the at least one hanger is oriented at an angle relative to the cross bar that is less than 180 degrees, but greater than 90 degrees.

18. The display fixture of claim 15, wherein when the first and the third downwardly depending mounting members are engaged with the two adjacent holes, the at least one hanger is oriented at an angle relative to the cross bar that is about 90 degrees.

* * * * *